US009632444B2

(12) United States Patent
Yamaguchi et al.

(10) Patent No.: US 9,632,444 B2
(45) Date of Patent: Apr. 25, 2017

(54) CHARGING UNIT

(71) Applicant: FUJI XEROX CO., LTD., Tokyo (JP)

(72) Inventors: Mikio Yamaguchi, Yokohama (JP); Yosuke Ninomiya, Yokohama (JP); Tomoya Oki, Yokohama (JP); Hiroshi Nishikawa, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/991,356

(22) Filed: Jan. 8, 2016

(65) Prior Publication Data

US 2017/0090326 A1 Mar. 30, 2017

(30) Foreign Application Priority Data

Sep. 25, 2015 (JP) ..... 2015-188914
Sep. 25, 2015 (JP) ..... 2015-188915
Sep. 25, 2015 (JP) ..... 2015-188916

(51) Int. Cl.
*G03G 15/02* (2006.01)
*G03G 13/02* (2006.01)

(52) U.S. Cl.
CPC ..... *G03G 13/025* (2013.01)

(58) Field of Classification Search
CPC ..... G03G 15/0225; G03G 15/0233; G03G 15/025
USPC ..... 399/100, 115, 176
See application file for complete search history.

(56) References Cited

U.S. PATENT DOCUMENTS 7,962,055 B2 6/2011 Takuma et al.
8,503,902 B2 * 8/2013 Alkins ..... G03G 15/0225 399/100
2005/0013631 A1 * 1/2005 Nishihama ..... G03G 15/0233 399/174
2007/0286633 A1 12/2007 Takuma et al.

FOREIGN PATENT DOCUMENTS

JP 2007-310357 A 11/2007
JP 2007-328144 A 12/2007
JP 2011-028305 A 2/2011
JP 4779642 B2 9/2011
JP 4978064 B2 7/2012

* cited by examiner

*Primary Examiner* — Hoang Ngo
(74) *Attorney, Agent, or Firm* — Oliff PLC

(57) ABSTRACT

A charging unit includes: a charging member that contacts with an image holding body holding an image and charges a surface of the image holding body; a support member that supports the charging member; and a pressing member that has plural springs that expand and contract in a direction from the support member to the image holding body, and pushes the support member toward the image holding body, and at least two of the plural springs of the pressing member are formed by a single metal wire.

14 Claims, 15 Drawing Sheets

CHARGING UNIT

CROSS-REFERENCE TO RELATED APPLICATIONS

This application is based on and claims priority under 35 USC 119 from Japanese Patent Application No. 2015-188914 filed on Sep. 25, 2015, Japanese Patent Application No. 2015-188915 filed on Sep. 25, 2015 and Japanese Patent Application No. 2015-188916 filed on Sep. 25, 2015.

BACKGROUND

Technical Field

The present invention relates to a charging unit.

SUMMARY

According an aspect of the invention, there is provided a charging unit comprising: a charging member that contacts with an image holding body holding an image and charges a surface of the image holding body; a support member that supports the charging member; and a pressing member that has plural springs that expand and contract in a direction from the support member to the image holding body, and pushes the support member toward the image holding body, wherein at least two of the plural springs of the pressing member are formed by a single metal wire.

BRIEF DESCRIPTION OF THE DRAWINGS

Exemplary embodiments of the present invention will be described in detail based on the following figures, wherein.

DESCRIPTION OF SYMBOLS

1 . . . Image forming apparatus; 10 . . . Image forming unit; 11 . . . Photoreceptor drum; 60 . . . Charger; 61 . . . Upstream charging roll; 62 . . . Downstream charging roll; 63 . . . Cleaning roll; 65 . . . Spring member; 70 . . . Bearing; 71 . . . First charging shaft bearing portion; 72 . . . Second charging shaft bearing portion; 80 . . . Housing; 751 . . . First spring receiving portion; 752 . . . Second spring receiving portion.

DETAILED DESCRIPTION

Exemplary embodiments of the present invention will be hereinafter described in detail with reference to the accompanying drawings.

Exemplary Embodiment 1

Figure 1:
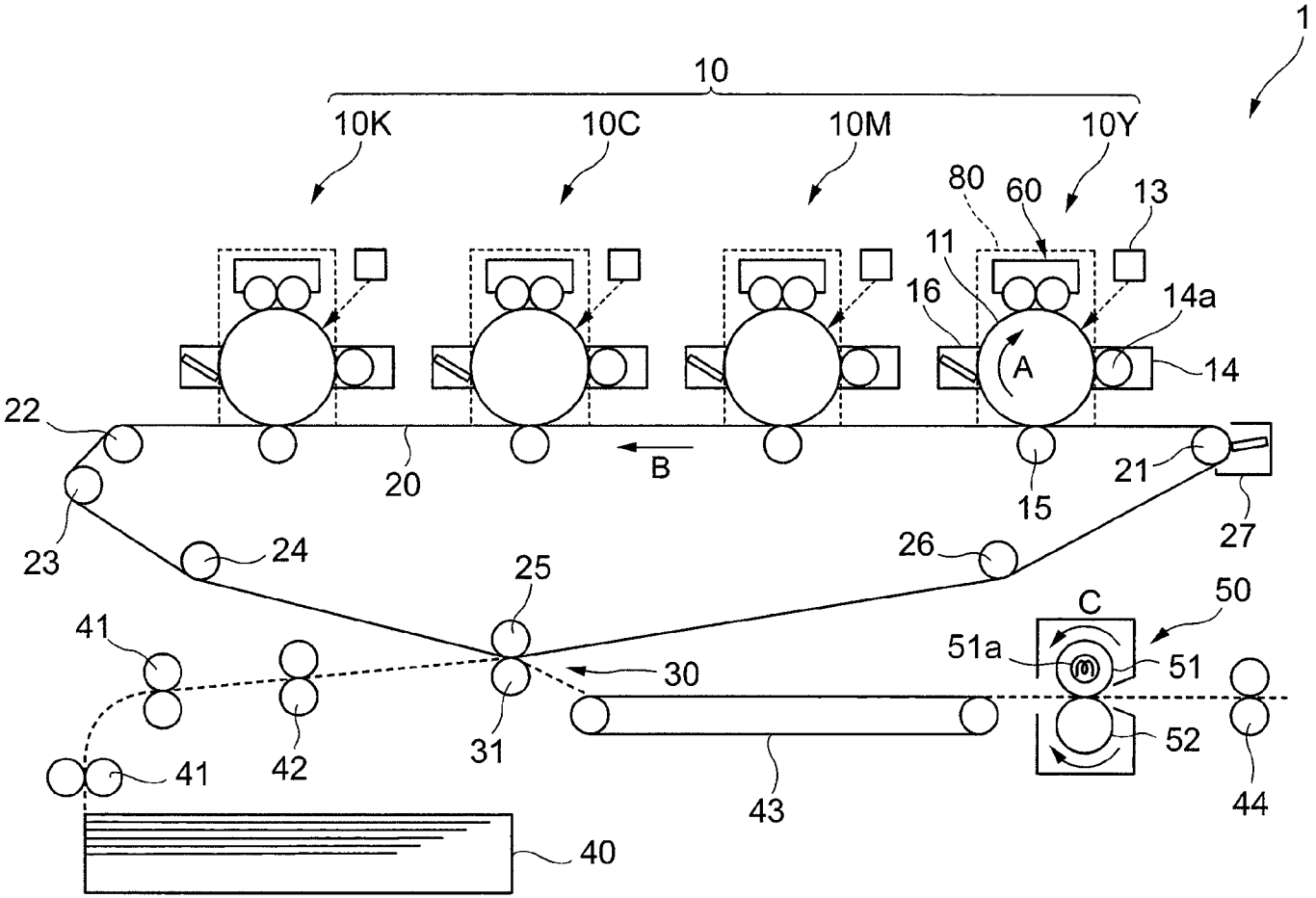
FIG. 1 shows the entire configuration of an image forming apparatus according to a first exemplary embodiment.

FIG. 1 shows the entire configuration of an image forming apparatus 1 according to a first exemplary embodiment. The image forming apparatus 1 is equipped with plural (in this exemplary embodiment, four) image forming units 10 (10Y, 10M, 100, and 10K) for forming toner images of respective colors by, for example, an electrophotographic method, an intermediate transfer belt 20 for holding the toner images of the respective colors formed by the image forming units 10 and transferred from them (primary transfer), a secondary transfer device 30 for secondarily transferring the superimposed primary transfer images from the intermediate transfer belt 20 to a sheet, and a fusing device 50 for fusing the secondary transfer image on the sheet.

Since the image forming units 10, that is, the yellow (Y) image forming unit 10Y, magenta (M) image forming unit 10M, cyan (C) image forming unit 10C, and black (K) image forming unit 10K, have the same structure except the color of toner used, the yellow image forming unit 10Y will be described below as a representative one.

The yellow image forming unit 10Y is equipped with a photoreceptor drum 11 (example image holding body) which is rotatable in the direction indicated by arrow A. The yellow image forming unit 10Y is also equipped with a charger 60, an exposing unit 13, a developing device 14, a primary transfer roll 15, and a drum cleaner 16 which are arranged around the photoreceptor drum 11 in the arrow A direction.

The charger 60 is equipped with two charging rolls, that is, an upstream charging roll 61 and a downstream charging roll 62 (see FIG. 3; described later) which are supported rotatably by bearings 70 (see FIG. 2; described later), are in contact with the photoreceptor drum 11, and rotate following the photoreceptor drum 11. A charging bias for charging the photoreceptor drum 11 negatively is applied to the upstream charging roll 61 and the downstream charging roll 62 from an electricity supply device (not shown).

In the exemplary embodiment, the photoreceptor drum 11 and the charger 60 are together housed in a housing 80 which can be attached to and detached from the image forming apparatus 1. The housing 80 and the charger 60 constitute a charging unit. The structures of the photoreceptor drum 11 and the charger 60 and how they are attached to the housing 80 will be described later in detail.

The exposing unit 13 forms an electrostatic latent image on the photoreceptor drum 11 being charged negatively by the charger 60 by selective optical writing using laser light, for example. In the exemplary embodiment, the exposing unit 13 illuminates, with light, portions (image portions) where to form toner images and does not illuminate portions (background portions) to become backgrounds, which is what is called an image portion exposing method. The light source of the exposing unit 13 may be an LED (light-emitting diode) light source instead of a laser light source.

The developing device 14 is equipped with a development roll 14*a* which is opposed to the photoreceptor drum 11 rotatably and contains, inside, a developer that includes a toner of the color concerned (a yellow toner in the case of the yellow image forming unit 10Y). In the exemplary embodiment, the developing device 14 employs what is called a two-component developer that includes a magnetic carrier and a toner that is colored in the predetermined color (yellow in the case of the yellow image forming unit 10Y). In this developer, the carrier has a positive charging polarity and the toner has a negative charging polarity.

Having a magnet (not shown) inside, the development roll 14*a* holds, on the surface of the development roll 14*a*, by magnetic force, a carrier of a developer whose toner has been stuck to the surface of the development roll 14*a* by electrostatic force. In the developing device 14, an electrostatic latent image formed on the photoreceptor drum 11 is developed using the developer (toner) that is held on the development roll 14*a*. A development bias for giving a negative potential to the development roll 14*a* is supplied to it, whereby negatively charged toner is transferred to negatively charged image portions of the electrostatic latent image, which is what is called an inversion developing method.

The primary transfer roll 15 is opposed to the photoreceptor drum 11 with the intermediate transfer belt 20 sandwiched between them, and is disposed so as to be in contact with the intermediate transfer belt 20 and rotates following the intermediate transfer belt 20. A primary transfer bias is applied to the primary transfer roll 15 with a polarity (in this example, positive) that is opposite to the toner charging polarity.

The drum cleaner 16 removes residuals (toner etc.) that are attached to the photoreceptor drum 11 after the primary transfer before charging.

The intermediate transfer belt 20 are wound rotatably on plural (in the exemplary embodiment, six) support rolls. Among the plural support rolls, a drive roll 21 not only serves to stretch the intermediate transfer belt 20 but also drives it rotationally in the direction indicated by arrow B. Driven rolls 22, 23, and 26 not only serve to stretch the intermediate transfer belt 20 but also rotate following the intermediate transfer belt 20 being driven by the drive roll 21. A correction roll 24 not only serves to stretch the intermediate transfer belt 20 but also functions as a steering roll for restricting a movement of the intermediate transfer belt 20 in the width direction of the intermediate transfer belt 20 which is perpendicular to its conveying direction (the correction roll 24 is disposed so as to be able to incline with its one end portion in the axial direction as a supporting point). A backup roll 25 not only serves to stretch the intermediate transfer belt 20 but also functions as a component of the secondary transfer device 30 (described later). A belt cleaner 27 for removing residuals (toner etc.) that are attached to the intermediate transfer belt 20 after a secondary transfer is disposed at such a position as to be opposed to the drive roll 21 with the intermediate transfer belt 20 sandwiched between them.

The secondary transfer device 30 is equipped with a secondary transfer roll 31 which is disposed so as to be in contact with the toner image transfer surface of the intermediate transfer belt 20 and the backup roll 25 which is disposed on the side of the back surface the intermediate transfer belt 20 and serves as a counter electrode against the secondary transfer roll 31. A secondary transfer bias having the same polarity (negative) as the toner charging polarity is applied to the backup roll 25. On the other hand, the secondary transfer roll 31 is grounded.

The image forming apparatus 1 is further equipped with a sheet conveying system for conveying a sheet. The sheet conveying system is composed of a sheets housing unit 40, conveying rolls 41, registration rolls 42, a conveying belt 43, and ejection rolls 44. In the sheet conveying system, a sheet that is picked up from the sheets housing unit 40 is conveyed by the conveying rolls 41, stopped temporarily by the registration rolls 42, and then sent to the secondary transfer device 30 with predetermined timing. After passing through the secondary transfer device 30, the sheet is conveyed to the fusing device 50 by the conveying belt 43. The sheet that is output from the fusing device 50 is ejected from the image forming apparatus 1 by ejection rolls 44.

The fusing device 50 is equipped with a heating roll 51 which has a heat source 51*a* such as a halogen lamp inside and is driven rotationally in the direction indicated by arrow C and a pressing roll 52 which is disposed rotatably so as to be in contact with the heating roll 51, rotates following the heating roll 51, and is pressed against the heating roll 51. The heating roll 51 is disposed on the side that is opposed to the toner image transfer surface of a sheet and the pressing roll 52 is disposed on the side opposite to the toner image transfer surface of a sheet.

Figure 2:
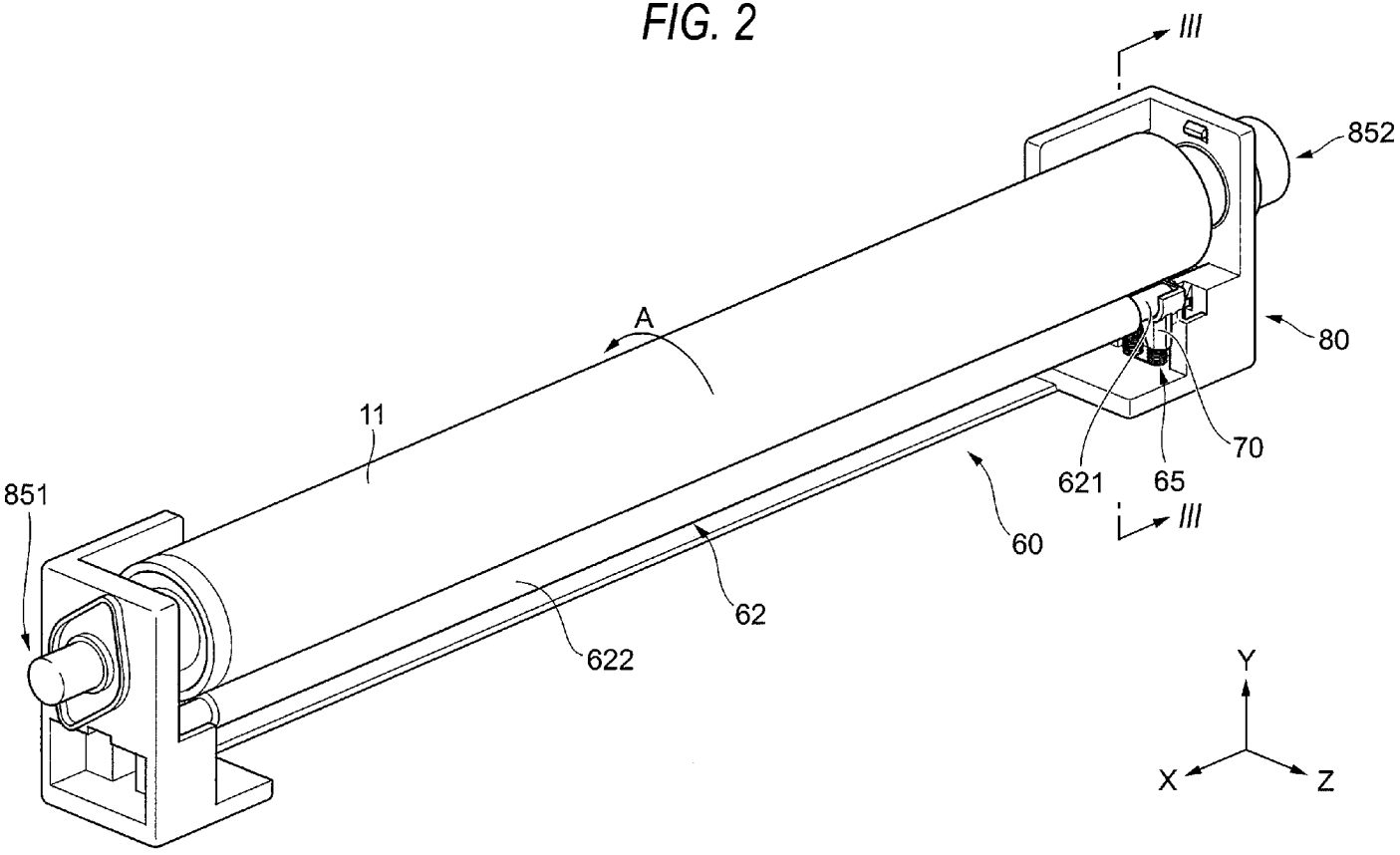
FIG. 2 is a perspective view showing a photoreceptor drum, a charger, and a housing which are essential units of the first exemplary embodiment.
Figure 3:
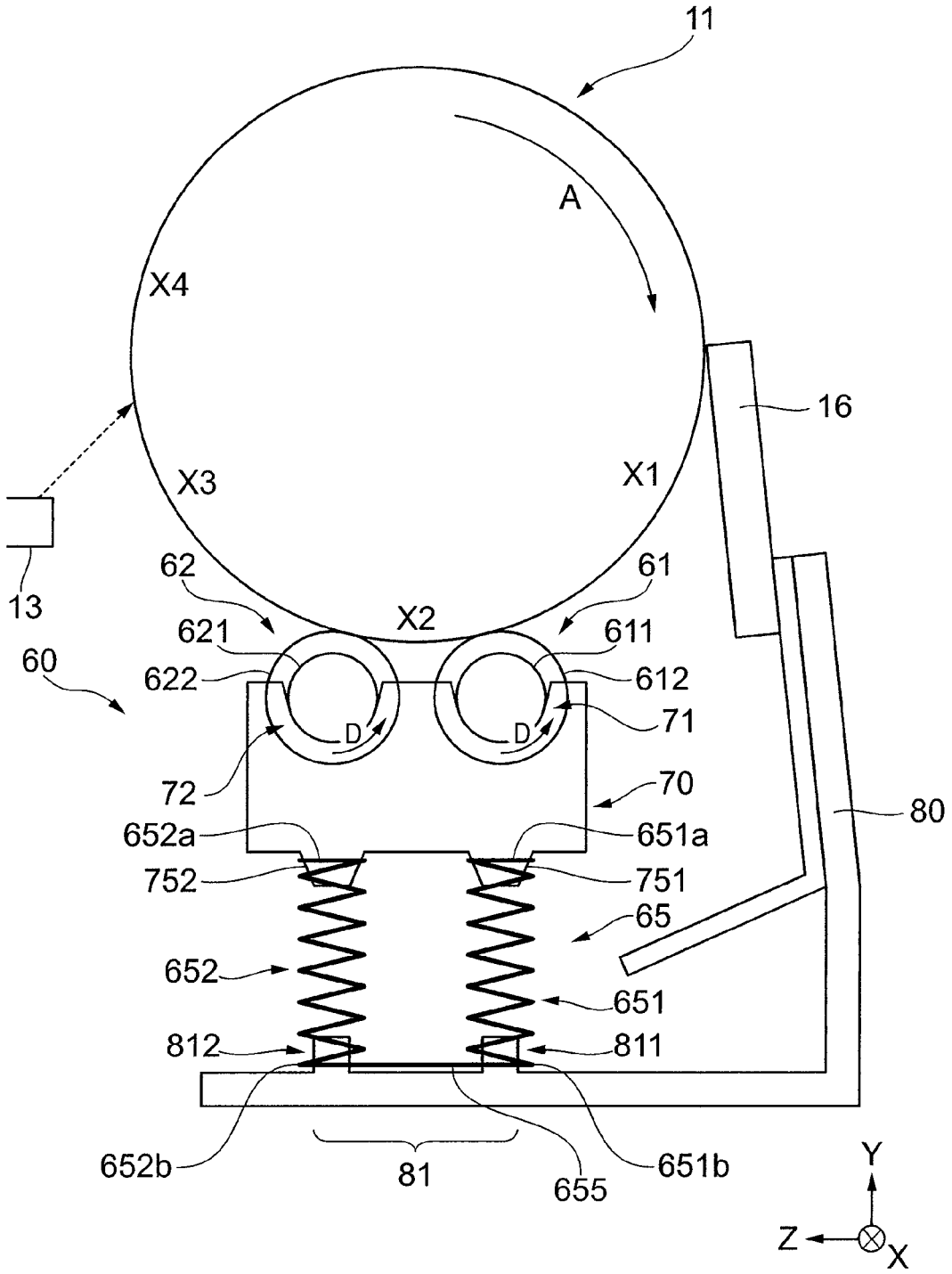
FIG. 3 is a sectional view taken along line III-III in FIG. 2.
Figure 4:
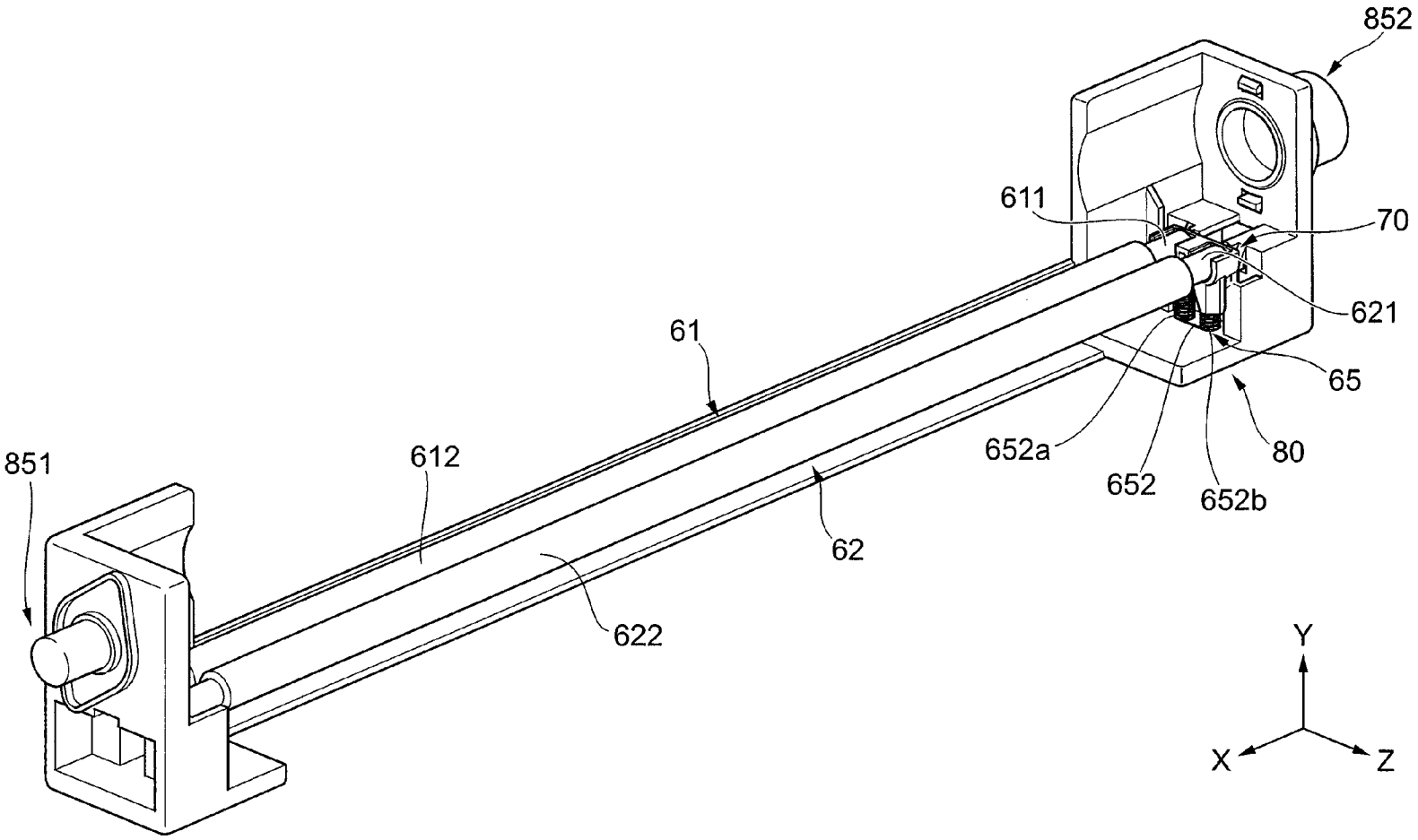
FIG. 4 is a perspective view showing the charger and the housing in a state that the photoreceptor drum is removed.

Next, the configuration of the charger 60 used in the exemplary embodiment and the relationship between the photoreceptor drum 11 and the charger 60 will be described. FIG. 2 is a perspective view showing the photoreceptor drum 11, the charger 60, and the housing 80 which are essential units of the exemplary embodiment. FIG. 3 is a sectional view taken along line III-III in FIG. 2. FIG. 4 is a perspective view showing the charger 60 and the housing 80 in a state that the photoreceptor drum 11 is removed. In FIGS. 2-4, the charger 60 and the photoreceptor drum 11 of the image forming unit 10 are drawn in such a manner as to be arranged oppositely in vertical direction to them drawn in FIG. 1.

As mentioned above, in the exemplary embodiment, the photoreceptor drum 11 and the charger 60 are housed in the housing 80. The photoreceptor drum 11 is driven rotationally in the predetermined direction (indicated by arrow A in FIG. 2) by a drive unit (not shown). The rotation axis of the photoreceptor drum 11 extends in the direction from the front side (the viewer's side in FIG. 1) to the rear side (the deep side in FIG. 1) of the image forming apparatus 1. The photoreceptor drum 11 is grounded in a state that it is housed in the housing 80.

As shown in FIGS. 3 and 4, the charger 60 used in the exemplary embodiment is equipped with the upstream charging roll 61 and the downstream charging roll 62 (example charging members) which are disposed rotatably so as to be in contact with the surface of the photoreceptor drum 11. The upstream charging roll 61 and the downstream charging roll 62 are disposed such positions as to be opposed to the photoreceptor drum 11 and are arranged side by side in the movement direction of the photoreceptor drum 11. The rotation axes of the upstream charging roll 61 and the downstream charging roll 62 extend parallel with the rotation axis of the photoreceptor drum 11. In other words, rotation axes of the upstream charging roll 61 and the downstream charging roll 62 extend in the direction from the front side to the rear side of the image forming apparatus 1. The upstream charging roll 61 and the downstream charging roll 62 rotate in the directions indicated by arrow D in FIG. 3 following the photoreceptor drum 11.

The charger 60 is equipped with the bearings 70 (example support members) which support front end portions and rear end portions, respectively, of the upstream charging roll 61 and the downstream charging roll 62. The charger 60 is also equipped with spring members 65 (example pressing members) which press the upstream charging roll 61 and the downstream charging roll 62 against the photoreceptor drum 11 via the front and rear bearings 70.

In the following description, as shown in FIGS. 2-4, the direction that is parallel with the rotation axes of the photoreceptor drum 11, the upstream charging roll 61 and the downstream charging roll 62 and goes from the front side to the rear side of the image forming apparatus 1 (see FIG. 1) will be referred to as the X direction. The direction in which the spring members 65 press the upstream charging roll 61 and the downstream charging roll 62 (i.e., the direction from the upstream charging roll 61 and the downstream charging roll 62 to the photoreceptor drum 11) will be referred to as the Y direction. Furthermore, the moving direction of the photoreceptor drum 11 in the region where the charger 60 and the photoreceptor drum 11 are opposed to each other will be referred to as the Z direction.

In the exemplary embodiment, the upstream charging roll 61 has a charging shaft 611 whose two portions are supported rotatably by the respective bearings 70 and a charging layer 612 which is formed on the outer circumferential surface of the charging shaft 611 and is brought into contact with the surface of the photoreceptor drum 11 to charge it.

The charging shaft 611 is made of a conductive material such as a metal. As shown in FIGS. 3 and 4, the charging shaft 611 is longer than the charging layer 612 in the axial direction (X direction) and the two end portions of the former project from the two ends of the latter. The two end portions of the charging shaft 611 projecting from the charging layer 612 are supported by the respective bearings 70.

The charging layer 612 is cylindrical and is formed on the outer circumferential surface of the charging shaft 611 in such a manner that the charging shaft 611 penetrates through the central space of the charging layer 612. Supplied with a voltage via the charging shaft 611, the charging layer 612 charges the photoreceptor drum 11 by exerting an electric field to the photoreceptor drum 11.

For example, the charging layer 612 may be formed by laying a conductive elastic layer and a surface layer on the charging shaft 611 in this order. The conductive elastic layer may be one formed by adding a conductive material such as carbon black or an ionic conductive material to an elastic material such as rubber. If necessary, materials that are usually added to rubber, such as a softening agent, a plasticizer, a hardener, a vulcanizing agent, a vulcanization accelerator, an antiaging agent, or a filler such as silica or calcium carbonate, may also be added.

The surface layer is formed to suppress contamination of the charging layer 612 by foreign matter such as residual toner. For example, the surface layer may be made of resin or rubber, specific examples of which are polyester, polyimide, copolymerized nylon, a silicone resin, an acrylic resin, polyvinyl butyral, an ethylene-tetrafluoroethylene copolymer, a melamine resin, fluororubber, an epoxy resin, polycarbonate, polyvinyl alcohol, cellulose, polyvinylidene chloride, polyvinyl chloride, polyethylene, and an ethylene-vinyl acetate copolymer. The surface layer may contain a conductive material to adjust its resistivity.

The downstream charging roll 62 is configured in the same manner as the upstream charging roll 61. That is, like the upstream charging roll 61, the downstream charging roll 62 has a charging shaft 621 and a charging layer 622. Two end portions of the charging shaft 621 that project from the charging layer 622 are supported by the respective bearings 70.

Figure 5:
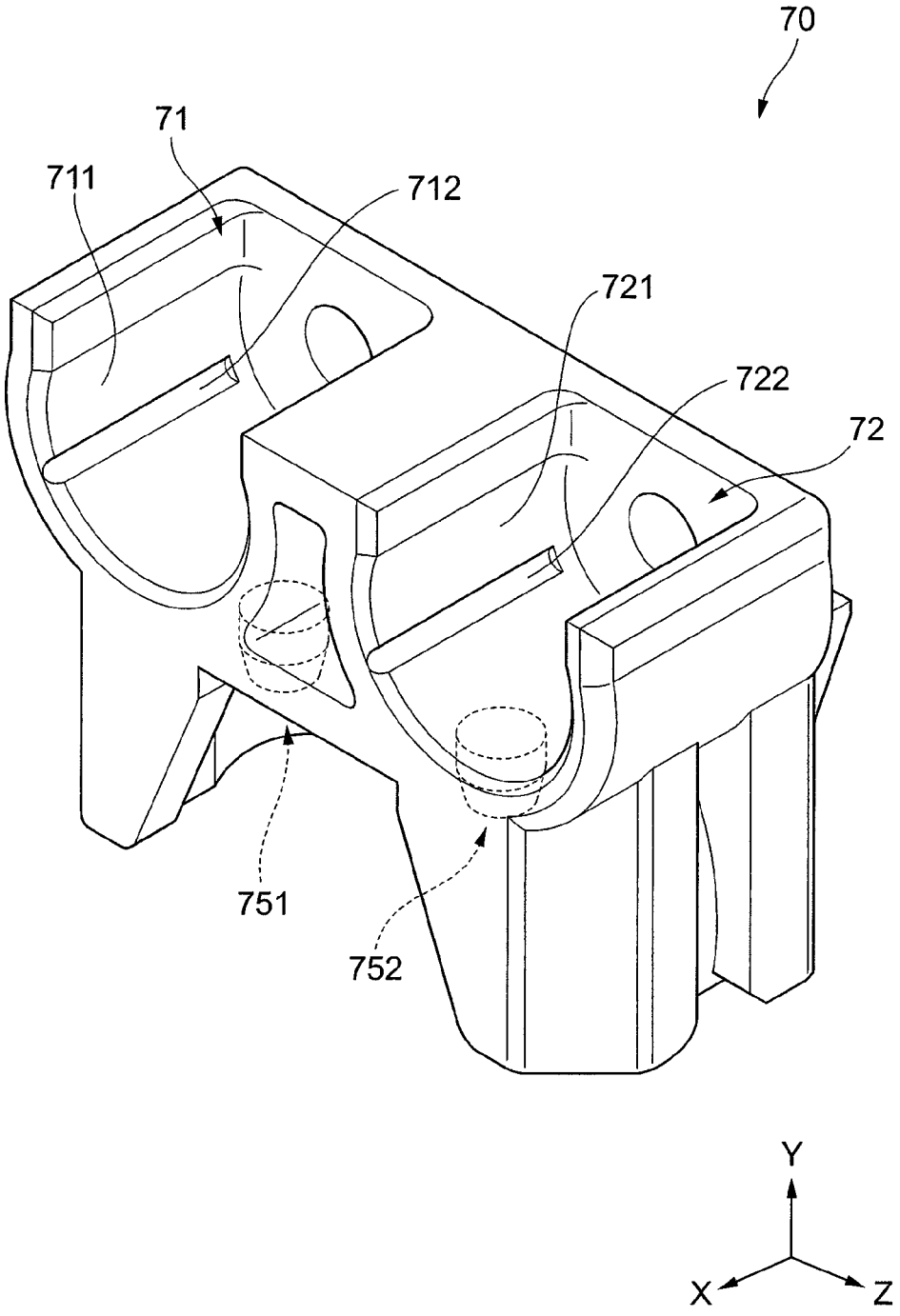
FIG. 5 is a perspective view of each bearing used in the first exemplary embodiment.

Next, the structure of each bearing 70 will be described. FIG. 5 is a perspective view of each bearing 70 used in the exemplary embodiment. In the charger 60 used in the exemplary embodiment, the bearing 70 that support the front end portions of the upstream charging roll 61 and the downstream charging roll 62 and the bearing 70 that support their rear end portions are symmetrical with each other with respect to the central YZ plane. The front bearing 70 will be described below as a representative example.

As shown in FIG. 3 (referred to above) and FIG. 5, the front bearing 70 used in the embodiment has a first charging shaft bearing portion 71 for supporting the end portion of the charging shaft 611 of the upstream charging roll 61 and a second charging shaft bearing portion 72 for supporting the end portion of the charging shaft 612 of the downstream charging roll 62. In the bearing 70, the first charging shaft bearing portion 71 and the second charging shaft bearing portion 72 are arranged side by side in the Z direction.

As shown in FIGS. 3 and 5, each of the first charging shaft bearing portion 71 and the second charging shaft bearing portion 72 has a recess shape that is opened on the side of the upstream charging roll 61 or the downstream charging roll 62 in its axial direction (X direction). When viewed from the upstream charging roll 61 or the downstream charging roll 62 in the X direction, the first charging shaft bearing portion 71 is shaped like a circular arc; thus, the first charging shaft bearing portion 71 has a cylindrical wall surface (first charging shaft receiving surface 711). Likewise, the second charging shaft bearing portion 72 has a second charging shaft receiving surface 721.

As shown in FIG. 5, each of the first charging shaft receiving surface 711 and the second charging shaft receiving surface 721 has a cut on the top side in FIG. 5 (on the destination side of the Y direction), whereby each of the first charging shaft receiving surface 711 and the second charging shaft receiving surface 721 are opened on the destination side of the Y direction.

The first charging shaft receiving surface 711 is a support surface for supporting the end portion of the charging shaft 611 of the upstream charging roll 61, and the diameter of the first charging shaft receiving surface 711 (i.e., the maximum distance between its confronting portions) is slightly longer than that of the charging shaft 611. Likewise, the second charging shaft receiving surface 721 is a support surface for supporting the end portion of the charging shaft 621 of the upstream charging roll 62, and the diameter of the second charging shaft receiving surface 721 is slightly longer than that of the charging shaft 621.

As a result, the first charging shaft bearing portion 71 supports the upstream charging roll 61 rotatably while the charging shaft 611 of the upstream charging roll 61 is in contact with the first charging shaft receiving surface 711. Likewise, the second charging shaft bearing portion 72 supports the downstream charging roll 62 rotatably while the charging shaft 621 of the downstream charging roll 62 is in contact with the second charging shaft receiving surface 721.

The first charging shaft receiving surface 711 and the second charging shaft receiving surface 721 are formed with grease grooves 712 and 722 which extend in the X direction and hold grease for reduce the friction between the charging shafts 611 and 621 and the first and second charging shaft receiving surfaces 711 and 721, respectively.

Furthermore, as shown in FIG. 3, the bearing 70 used in the exemplary embodiment is formed with a first spring receiving portion 751 and a second spring receiving portion 752 (described later) to which a first compression spring 651 and a second compression spring 652 of the associated spring member 65 are attached, respectively.

The first spring receiving portion 751 and the second spring receiving portion 752 of the bearing 70 are projections that project toward the source side of the Y direction. As shown in FIG. 3, the first spring receiving portion 751 and the second spring receiving portion 752 are disposed closer to the source side of the Y direction than the first charging shaft bearing portion 71 and the second charging shaft bearing portion 72 are, respectively.

Next, the structure of each spring member 65 will be described. As shown in FIG. 3, each spring member 65 used in the exemplary embodiment has the first compression spring 651 and the second compression spring 652 (example plural springs) formed by winding a metal wire into a coil form. The spring member 65 also has a straight portion 655 which is a metal wire that extends straightly so as to connect to the first compression spring 651 and the second compression spring 652.

The spring member 65 is formed by connecting the first compression spring 651, the second compression spring 652, and the straight portion 655 into a single, continuous member. In other words, the spring member 65 is made of a single metal wire as a whole. There are no limitations on the material of the spring member 65; one example material is SUS (stainless steel).

An end portion (first end portion 651*a*) of the first compression spring 651 and an end portion (second end portion 652*a*) of the second compression spring 652 of the spring member 65 are attached to the first spring receiving portion 751 and the second spring receiving portion 752 of the bearing 70, respectively. A connection portion (first connection portion 651*b*) of the first compression spring 651 and the straight portion 655 and a connection portion (second connection portion 652*b*) of the second compression spring 652 and the straight portion 655 of the spring member 65 are attached to a first projection 811 (described later) and a second projection 812 (described later) of the housing 80, respectively.

As described later in detail, in the exemplary embodiment, the first connection portion 651*b* of the spring member 65 is fitted with the first projection 811 of the housing 80 so as to establish a close fit relationship. On the other hand, the second connection portion 652*b* of the spring member 65 is fitted with the second projection 812 of the housing 80 so as to establish a clearance fit relationship.

In the exemplary embodiment, as shown in FIG. 3, in a state that spring members 65 and the charger 60 are attached to the housing 80, the end portion of the charging shaft 611 of the upstream charging roll 61 is located on an extension, in its expansion/contraction direction, of the first compression spring 651 of each spring member 65. Likewise, the end portion of the charging shaft 621 of the downstream charging roll 62 is located on an extension, in its expansion/contraction direction, of the second compression spring 652 of each spring member 65. In the exemplary embodiment, the first compression spring 651 and the second compression spring 652 of each spring member 65 constitute a first pressing portion and a second pressing portion, respectively.

Figure 6:
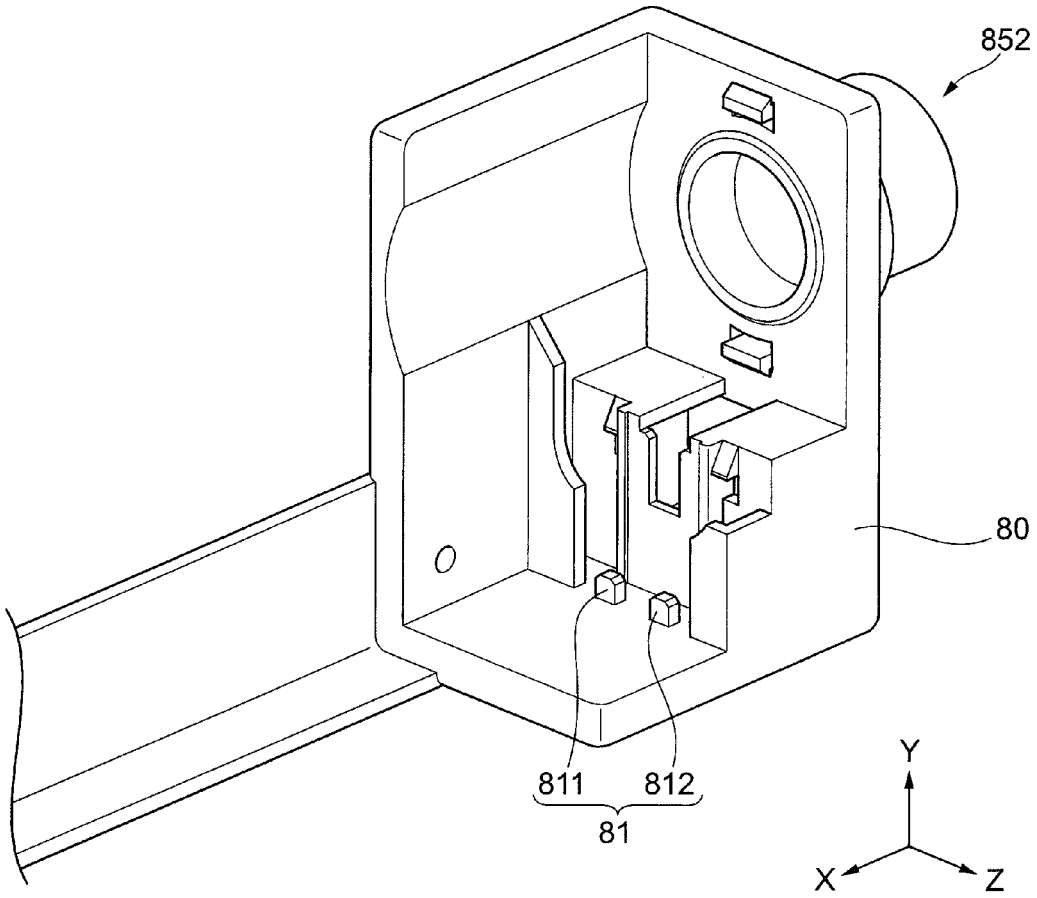
FIG. 6 is a perspective view showing a housing in a state that the photoreceptor drum and the charger are removed.

Next, the structure of the housing 80 will be described. FIG. 6 is a perspective view showing the housing 80 in a state that the photoreceptor drum 11 and the charger 60 are removed. As shown in FIG. 4 (referred to above) and FIG. 6, the housing 80 used in the exemplary embodiment extends long in the X direction as a whole. The housing 80 has, at a front end position and a rear end position, attachment portions 81 to which the respective spring member 65 are attached.

As shown in FIG. 3 (referred to above) and FIG. 6, each attachment portion 81 of the housing 80 has the first projection 811 and the second projection 812 which are fitted with (attached to) the first connection portion 651*b* and the second connection portion 652*b* of the associated spring member 65.

The first projection 811 and the second projection 812 are projections that project toward the destination side of the Y direction, and are arranged side by side in the Z direction with a predetermined gap. In this example, the interval between the first projection 811 and the second projection 812 is set equal to the length of the straight portion 655 of the associated spring member 65.

In the exemplary embodiment, as shown in FIG. 4, the housing 80 has a rear support portion 851 and a front support portion 852 which support a rear end portion and a front end portion of the photoreceptor drum 11, respectively. In the exemplary embodiment, the photoreceptor drum 11 is driven rotationally by a drive unit (not shown) via the rear support portion 851. The front support portion 852 supports the photoreceptor drum 11 rotatably.

In a state that the spring members 65, the charger 60, and the photoreceptor drum 11 are attached to the housing 80, the upstream charging roll 61 and the downstream charging roll 62 are pressed against the surface of the photoreceptor drum 11 by the elastic forces of the first compression springs 651 and the second compression springs 652 of the spring members 65.

Figure 7:
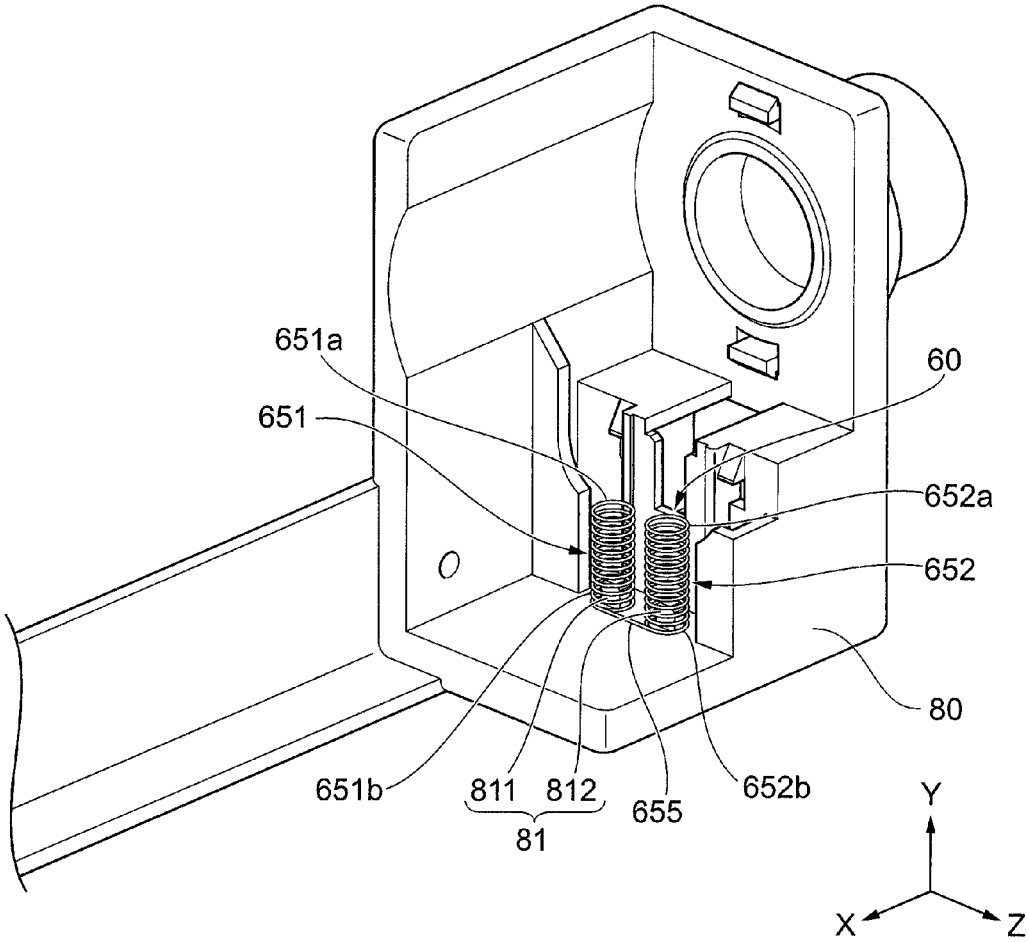
FIG. 7 is a perspective view showing a state that one spring member is attached to the housing.
Figure 8:
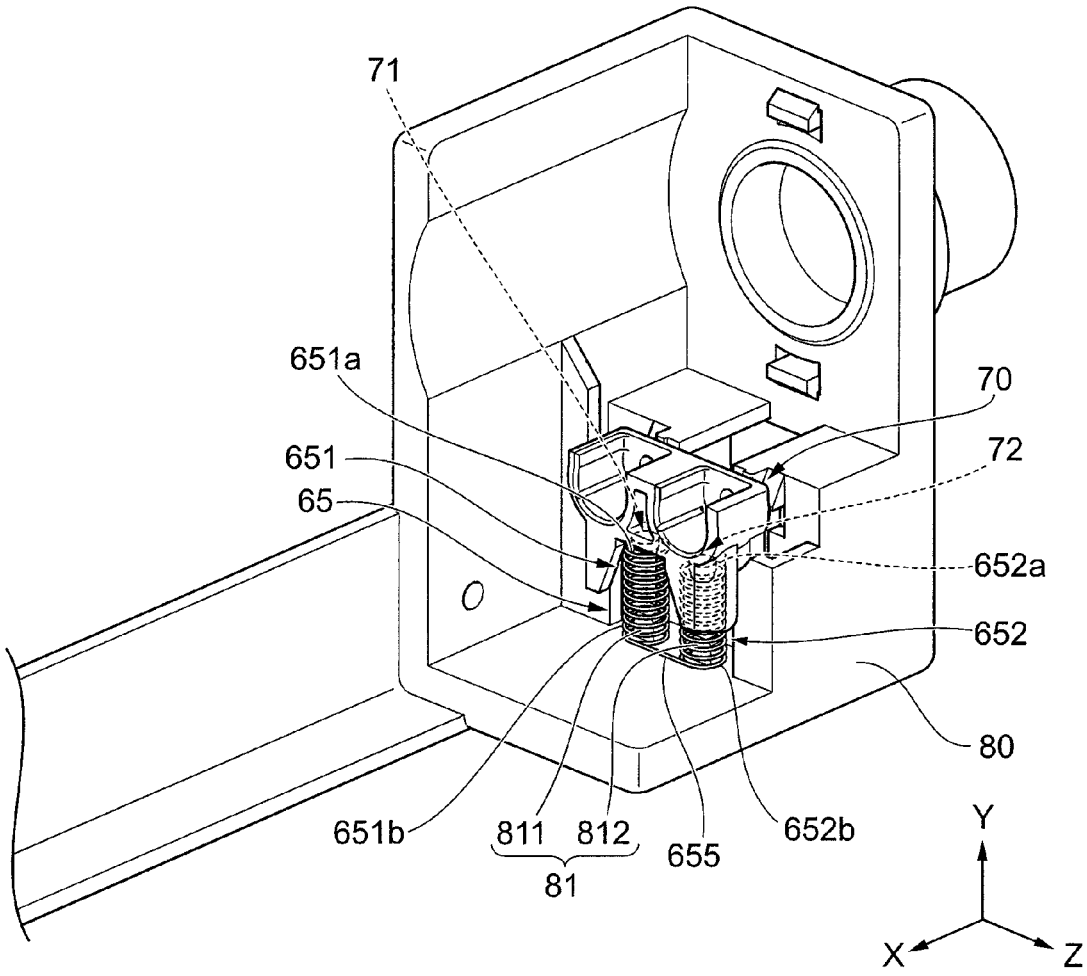
FIG. 8 is a perspective view showing a state that one spring member and one bearing are attached to the housing.

Next, an example procedure of assembling the charger 60, the spring members 65, the housing 80, and the photoreceptor drum 11 shown in FIGS. 2 and 3 will be described. FIG. 7 is a perspective view showing a state that one spring member 65 is attached to the housing 80. FIG. 8 is a perspective view showing a state that one spring member 65 and one bearing 70 are attached to the housing 80.

In the exemplary embodiment, first, the spring members 65 are attached to the front and rear attachment portions 81 of the housing 80, respectively, by moving the spring members 65 toward the source side of the Y direction. More specifically, the first connection portion 651*b* and the second connection portion 652*b* of each spring member 65 are fitted with the first projection 811 and the second projection 812 of the associated attachment portion 81, respectively, by moving the former from the destination side of the Y direction. As a result, the first projection 811 and the second projection 812 are inserted into the inner circumferences of the first connection portion 651*b* and the second connection portion 652*b* of each spring member 65, respectively.

Then the first connection portion 651*b*, attached to the first projection 811, of each spring member 65 is swaged by pinching the first connection portion 651*b* with a tool or the like to establish a state that the first compression spring 651 of the spring member 65 is fitted with the first projection in a close fit relationship. On the other hand, the second connection portion 652*b*, attached to the second projection 812, of each spring member 65 is not pinched. As a result, the second compression spring 652 of the spring member 65 is kept in a state that it is fitted with the second projection 812 in a clearance fit relationship.

As described above, in the exemplary embodiment, the two compression springs (first compression spring 651 and second compression spring 652) are connected to each other by the straight portion 655 to form each spring member 65 by a single metal wire. With this structure, the whole of each spring member 65 can be fixed to the housing 80 merely by fitting one (in this example, first compression spring 651) of the two compression springs with the attachment portion 81 (first projection 811) by close fit. This makes it simpler to attach each spring member 65 than in, for example, a case that two separate compression springs are fixed by attaching them to the first projection 811 and the second projection 812 of the housing 80, respectively.

Where both of the first compression spring 651 and the second compression spring 652 are fitted with each attachment portion 81 so as to establish a close fit relationship, there may occur, for example, an event that the spring member 65 is distorted depending on, for example, the dimensional allowances of the housing 80 (attachment portion 81) and the spring member 65.

In contrast, in the exemplary embodiment, since only one (in this example, second compression spring 652) of the two compression springs of each spring member 65 is fitted with the attachment portion 81 (second projection 812) by clearance fit, the spring member 65 is prevented from being distorted even if the dimensions of the housing 80 and the spring member 65 have errors.

Although in the above example the first compression spring 651 of the spring member 65 is fitted with the first projection 811 so as to establish a close fit relationship, an alternative structure is possible that the second compression spring 652 is fitted with the second projection 812 so as to establish a close fit relationship and the first compression spring 651 of the spring member 65 is fitted with the first projection 811 so as to establish a clearance fit relationship.

Subsequently, the bearings 70 are attached from above (i.e., from the destination side of the Y direction) to the spring members 65 which are attached to the front portion and the rear portion of the housing 80, respectively. More specifically, each bearing 70 is attached to the associated spring member 65 by inserting the first spring receiving portion 751 and the second spring receiving portion 752 of the bearing 70 into the first end portion 651*a* of the first compression spring 651 and the second end portion 652*a* of the second compression spring 652 of the spring member 65.

As a result, the first charging shaft bearing portion 71 and the second charging shaft bearing portion 72 of the bearing 70 that is attached to the front portion of the housing 80 are opposed to those of the bearing 70 that is attached to the rear portion of the housing 80, respectively, with the inside space of the housing interposed in between.

Since as described above each spring member 65 is fixed to the housing 80 in such a manner that its first compression spring 651 is fitted with the first projection 811 so as to establish a close fit relationship. Therefore, when each bearing 70 is attached to the associated spring member 65, movement of the spring member 65 and disengagement of the spring member 65 from the housing can be prevented. This makes work of attaching the bearings 70 easier than in, for example, a case that the spring members 65 are not fixed to the housing 80.

Subsequently, the upstream charging roll 61 and the downstream charging roll 62 are attached to the bearings 70 which are attached to the front and rear spring members 65. More specifically, the upstream charging roll 61 is attached to the bearings 70 by inserting its charging shaft 611 to the first charging shaft bearing portions 71 of the bearings 70 from above (i.e., from the destination side of the Y direction). Likewise, the downstream charging roll 62 is attached to the bearings 70 by inserting its charging shaft 621 to the second charging shaft bearing portions 72 of the bearings 70 from above (i.e., from the destination side of the Y direction).

Then the photoreceptor drum 11 is attached to the housing 80. More specifically, the rear end portion and the front end portion of the photoreceptor drum 11 are inserted into the rear support portion 851 and the front support portion 852 of the housing 80, respectively.

The photoreceptor drum 11 is attached while its surface pushes the upstream charging roll 61 and the downstream charging roll 62 downward (i.e., toward the source side of the Y direction). As a result, the bearings 70 are pushed down via the upstream charging roll 61 and the downstream charging roll 62 and hence the first compression springs 651 and the second compression springs 652 of the spring members 65 are deformed elastically.

When the photoreceptor drum 11 is attached to the housing 80, the bearings 70 are pushed toward the photoreceptor drum 11 (i.e., toward the destination side of the Y direction) by the elastic recovery forces of the first compression springs 651 and the second compression springs 652 of the spring members 65. Pushed by the bearings 70, the upstream charging roll 61 and the downstream charging roll 62 are pressed against the surface of the photoreceptor drum 11.

Incidentally, in the charger 60 which charges the photoreceptor drum 11 by means of the two charging rolls (upstream charging roll 61 and downstream charging roll 62), to increase the contactness between the photoreceptor drum 11 and each of the upstream charging roll 61 and the downstream charging roll 62, it is necessary that the spring member 65 produce stronger elastic recovery forces than in, for example, a case of using a single charging roll.

If only one compression spring were used on each side (front side or rear side) to push the upstream charging roll 61 and the downstream charging roll 62, a heavy load would tend to be imposed on each portion of the housing 80 or each bearing 70 from the associated compression spring. As a result, the housing 80 and the bearings 70 would be required to be high in rigidity and strength and hence tend to be increased in size.

If two separate compression springs were used on each side, work of attaching the individual compression springs would be so complex as to lower the assembling efficiency of the charger 60.

In contrast, in the exemplary embodiment, the two compression springs (first compression spring 651 and second compression spring 652) are connected to each other by the straight portion 655 to form each spring member 65 by a single metal wire. And one compression spring (in this example, first compression spring 651) is attached to the housing 80 by close fit and the other compression spring (in this example, second compression spring 652) is attached to the housing 80 by clearance fit. This structure can prevent work of assembling the charger 60 from becoming complex and prevent size increase of the housing 80 and the bearings 70 while preventing lowering of the contactness between the photoreceptor drum 11 and each of the upstream charging roll 61 and the downstream charging roll 62.

(Modification 1)

Next, modifications of the charger 60 according to the first exemplary embodiment and the spring member 65 used therein will be described. In the following description, the same members etc. as corresponding ones shown in FIGS. 1-8 will be given the same reference symbols as the latter and will not be described in detail.

Figure 9:
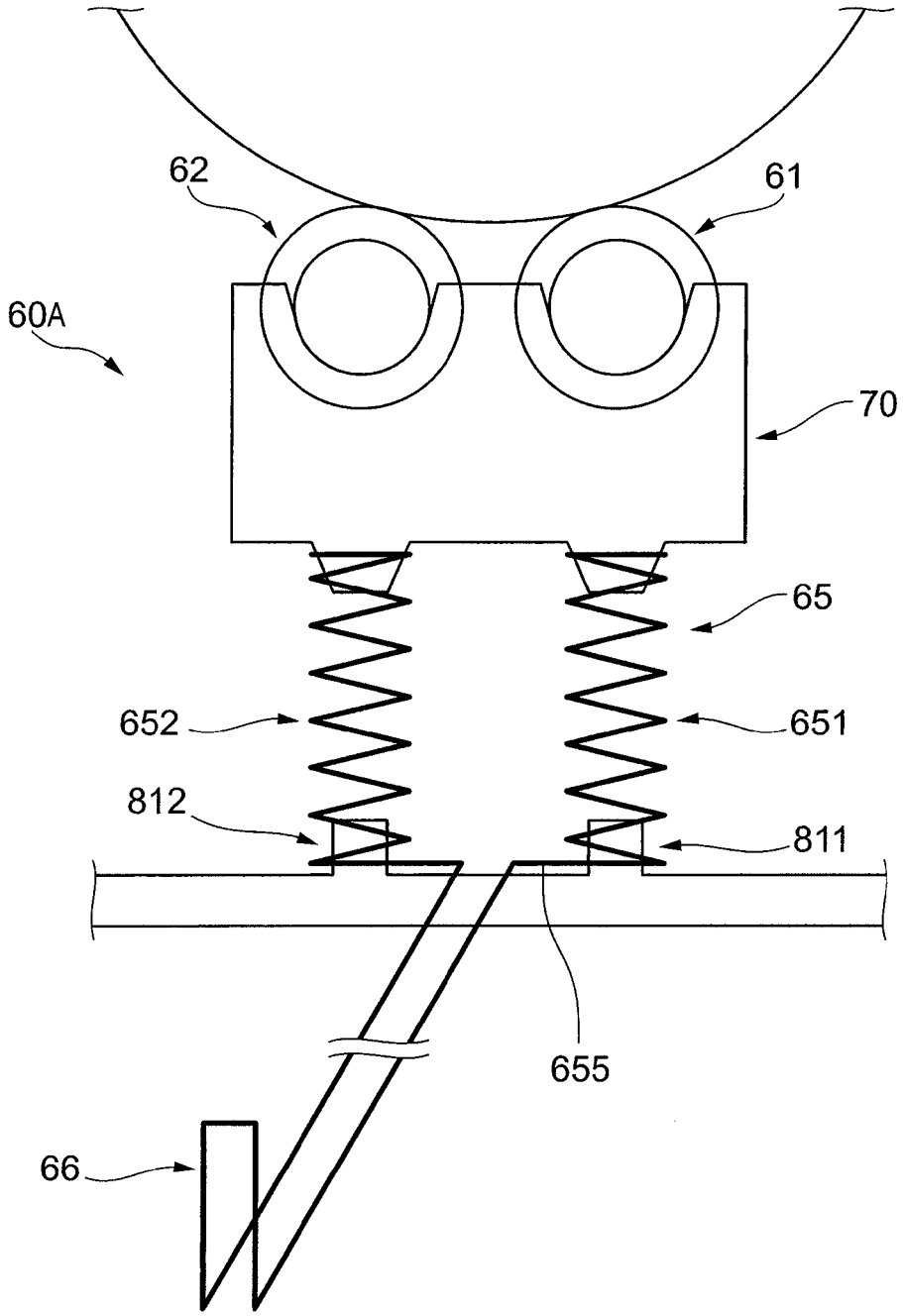
FIG. 9 shows a charger according to a first modification which is a modified version of the charger according to the first exemplary embodiment.

FIG. 9 shows a charger 60A according to a first modification which is a modified version of the charger 60 according to the first exemplary embodiment. In the first modification, an electricity supply device 66 for supplying a charging bias to the upstream charging roll 61 and the downstream charging roll 62 is connected to each spring member 65.

More specifically, in each spring member 65, the electricity supply device 66 (example electricity supply unit) is connected to the straight portion 655 which connects the first compression spring 651 and the second compression spring 652. In the charger 60A according to the first modification, a charging bias is applied to the upstream charging roll 61 and the downstream charging roll 62 from the electricity supply device 66 via each spring member 65 and each bearing 70.

Also in the first modification, the first compression spring 651 is attached to the first projection 811 of the housing 80 by close fit and the second compression spring 652 is attached to the second projection 812 of the housing 80 by clearance fit.

In the first modification, the charger 60A is configured in such a manner that the electricity supply device 66 is directly connected to each spring member 65. In other words, each spring member 65 has an electricity supply function of supplying electricity to the upstream charging roll 61 and the downstream charging roll 62. As a result, the number of components of each of the image forming apparatus 1 and the image forming unit 10 (see FIG. 1 for both) is made smaller than in, for example, a case that an electricity supply device is provided separately from the spring members 65. Thus, the image forming apparatus 1 and the image forming unit 10 are reduced in cost.

Since the spring members 65 which are attached to the bearings 70 which support the upstream charging roll 61 and the downstream charging roll 62 have the electricity supply function, the supply of electricity to the upstream charging roll 61 and the downstream charging roll 62 can be done stably.

(Modification 2)

Figure 10:
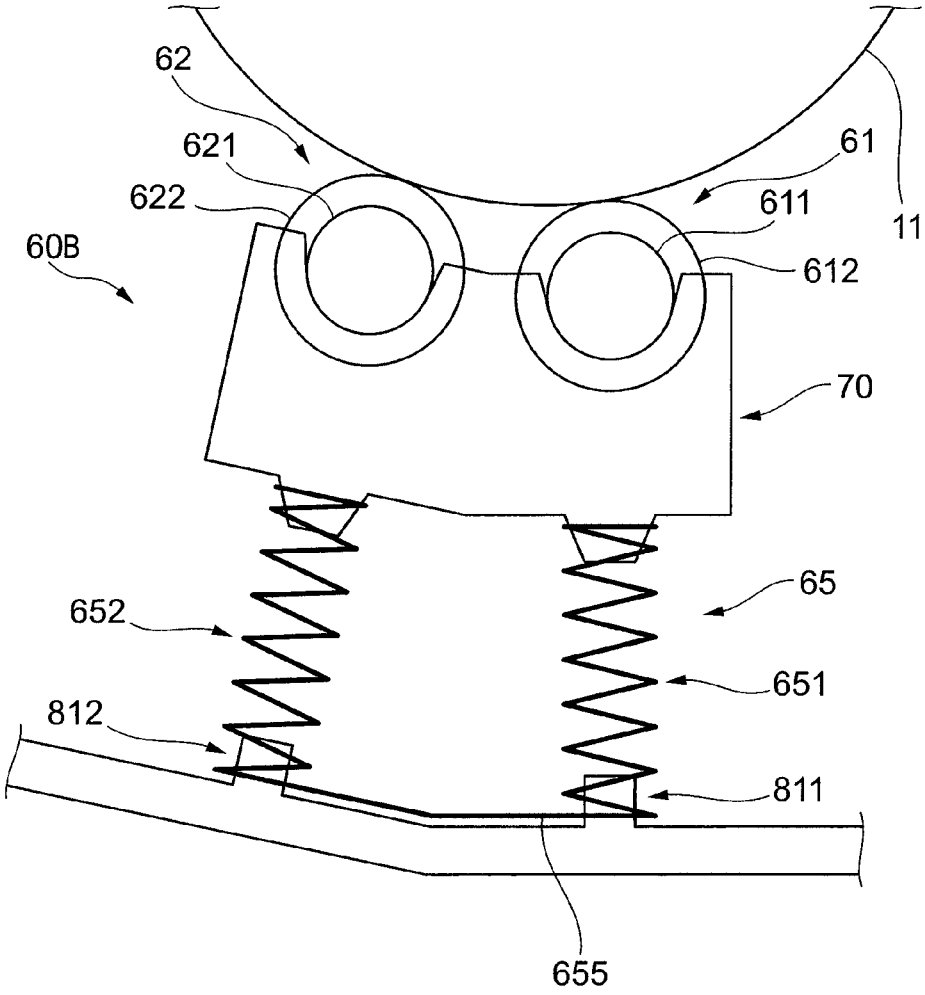
FIG. 10 shows a charger according to a second modification which is a modified version of the charger according to the first exemplary embodiment.

FIG. 10 shows a charger 60B according to a second modification which is a modified version of the charger 60 according to the first exemplary embodiment. In each spring member 65 used in the second modification, the expansion/contraction directions of the first compression spring 651 and the second compression spring 652 are opposite to each other. In other words, in each spring member 65 used in the second modification, the first compression spring 651 and the second compression spring 652 are disposed in such a manner that their distance decreases as the position goes away from the straight portion 655 (actually bent at the center).

Also in the second modification, the first compression spring 651 is attached to the first projection 811 of the housing 80 by close fit and the second compression spring 652 is attached to the second projection 812 of the housing 80 by clearance fit.

The bearings 70 used in the second modification support the upstream charging roll 61 in such a manner that its charging shaft 611 is located on the expansion/contraction directions of the first compression springs 651, and support the downstream charging roll 62 in such a manner that its charging shaft 621 is located on the expansion/contraction directions of the second compression spring 652.

With the above structure, the second modification makes it possible to push the upstream charging roll 61 and the downstream charging roll 62 toward the rotation axis of the photoreceptor drum 11, which in turn allows the upstream charging roll 61 and the downstream charging roll 62 to contact the photoreceptor drum 11 stably.

As a result, better contact can be secured between the photoreceptor drum 11 and each of the upstream charging roll 61 and the downstream charging roll 62 and hence the photoreceptor drum 11 can be charged more effectively than in a case that the structure of this modification is not employed.

(Modifications 3 and 4)

Figure 11A:
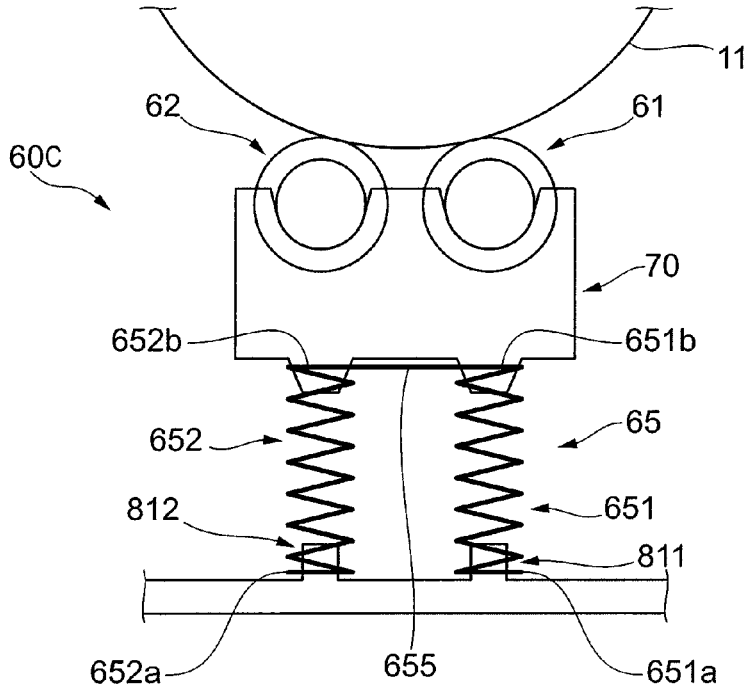
FIGS. 11A and 11B show chargers according to third and fourth modifications, respectively, which are modified versions of the charger according to the first exemplary embodiment.
Figure 11B:
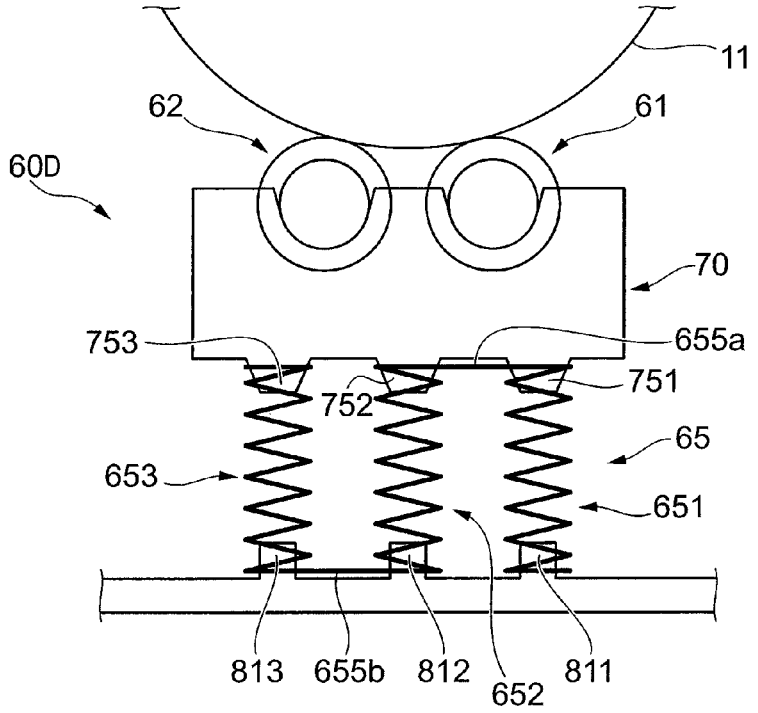

FIGS. 11A and 11B show chargers 600 and 60D according to third and fourth modifications, respectively, which are modified versions of the charger 60 according to the first exemplary embodiment.

In the examples shown in FIGS. 1-10, the first end portion 651*a* of the first compression spring 651 of each spring member 65 is attached to the first spring receiving portion 751 of the associated bearing 70 and the second end portion 652*a* of the second compression spring 652 of each spring member 65 is attached to the second spring receiving portion 752 of the associated bearing 70.

In contrast, in the charger 60C according to the third modification shown in FIG. 11A, the spring members 65 are attached to the housing 80 and the bearings 70 so as to be inverted in the vertical direction from those shown in FIGS. 1-10. More specifically, the first end portion 651*a* of the first compression spring 651 of each spring member 65 is attached to the first projection 811 of the housing 80 and the second end portion 652*a* of the second compression spring 652 of each spring member 65 is attached to the second projection 812 of the housing 80.

In this case, for example, it is possible to fit the first end portion 651*a* with the first projection 811 so as to establish a close fit relationship and to fit the second end portion 652*a* with the second projection 812 so as to establish a clearance fit relationship.

In the charger 60D according to the fourth modification shown in FIG. 11B, each spring member 65 has three compression springs (first compression spring 651, second compression spring 652, and third compression spring 653). More specifically, as shown in FIG. 11B, the first compression spring 651 and the second compression spring 652 are connected to each other by a first straight portion 655*a* and the second compression spring 652 and the third compression spring 653 are connected to each other by a second straight portion 655*b*. In this manner, the whole of each spring member 65 is formed by a single metal wire.

In this case, each bearing 70 having three spring receiving portions (first spring receiving portion 751, second, second spring receiving portion 752, spring receiving portion 753) and a housing 80 having three projections (first projection 811, second projection 812, and third projection 813) on each side may be used.

One of the three compression springs (first compression spring 651, second compression spring 652, and third compression spring 653) is fitted with the associated one of the three projections (first projection 811, second projection 812, and third projection 813) of the housing 80 so as to establish a close fit relationship and the other compression springs are fitted with the associated projections so as to establish a clearance fit relationship. As in the above-described examples, this structure can prevent work of assembling the charger 60D from becoming complex and prevent size increase of the housing 80 and the bearings 70 while preventing lowering of the contactness between the photoreceptor drum 11 and each of the upstream charging roll 61 and the downstream charging roll 62.

In the charger 60D shown in FIG. 11B, each spring member 65 has the three compression springs (first compression spring 651, second compression spring 652, and third compression spring 653) which are formed by a single metal wire as a whole. For example, an alternative structure is possible in which two adjoining ones (e.g., first compression spring 651 and second compression spring 652) of the three compression springs constitute a spring member that is formed by a single metal wire and the remaining compression spring (third compression spring 653) is made another spring member that is formed by a single metal.

In the examples shown in FIG. 1 to FIGS. 11A and 11B, the two charging rolls (upstream charging roll 61 and downstream charging roll 62) are supported by the bearings 70. However, the concepts of the first exemplary embodiment and its modifications may be applied to a case that the one charging roll is supported by the bearings 70 or a case that three or more charging rolls are supported by the bearings 70. Each of the front and rear bearings 70 which supports the two charging rolls may be divided into two bearings to support the two charging rolls one by one.

Exemplary Embodiment 2

Figure 12:
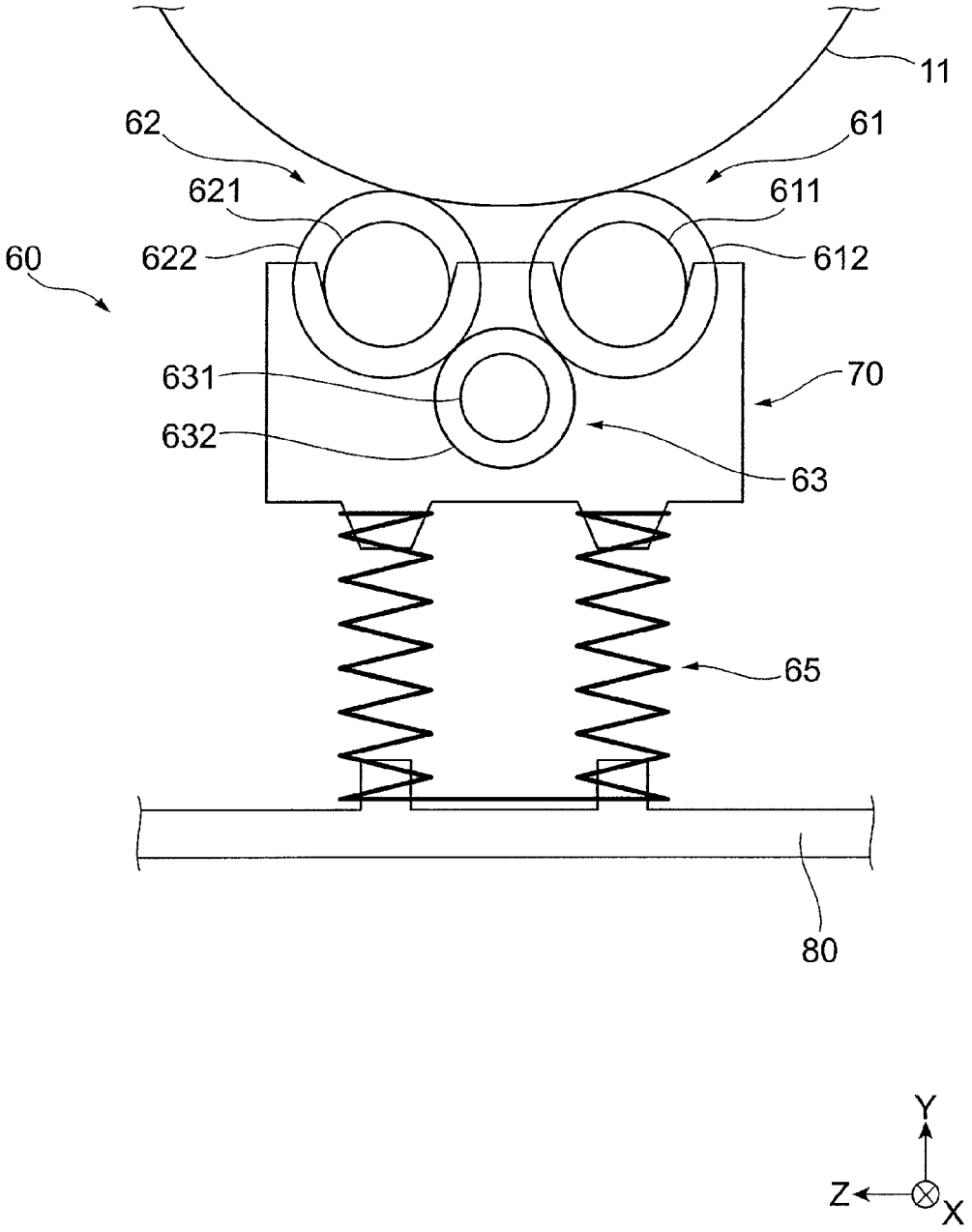
FIG. 12 shows a charger according to a second exemplary embodiment.

Next, a second exemplary embodiment of the invention will be described. FIG. 12 shows the configuration of a charger 60E according to the second exemplary embodiment. The charger 60E according to the second exemplary embodiment is different from the charger 60 according to the first exemplary embodiment in that the former is additionally equipped with a cleaning roll 63 for cleaning the surfaces of the upstream charging roll 61 and the downstream charging roll 62.

The cleaning roll 63 extends in the X direction and has a cleaning shaft 631 which is supported rotatably by the bearings 70. The cleaning roll 63 also has a cleaning layer 632 which is formed on the outer circumferential surface of the cleaning shaft 631 and is brought into contact with the surfaces of the charging layer 612 of the upstream charging roll 61 and the charging layer 622 of the downstream charging roll 62 to clean the charging layers 612 and 622.

The cleaning shaft 631 is made of, for example, a resin material or a metal material and has a cylindrical shape. The cleaning layer 632 is formed on the outer circumferential surface of the cleaning shaft 631 in such a manner that the cleaning shaft 631 penetrates through the central space of the cleaning layer 632. The cleaning layer 632 rotates following the upstream charging roll 61 and the downstream charging roll 62 in a state that it in contact with the charging layer 612 of the upstream charging roll 61 and the charging layer 622 of the downstream charging roll 62, and thereby removes foreign matter that is stuck to the charging layers 612 and 622, such as dust and residual toner.

For example, the cleaning layer 632 is made of porous foam of a foamable resin, rubber, or the like such as polyurethane, polyethylene, polyamide, or polypropylene. From the viewpoints of cleaning foreign matter efficiently through following-rotation-produced friction against the charging layers 612 and 622, preventing scratching the surfaces of the charging layers 612 and 622, and lowering the probability of occurrence of tearing-off or damaging of the cleaning layer 632 over a long time, polyurethane is most preferable which is highly resistant to ripping, pulling, or like stress.

The cleaning roll 63 may be what is called a spiral roll in which a string-like or flat-plate-like cleaning layer 632 is wound around the cleaning shaft 631 spirally.

As described above, in the charger 60E according to this exemplary embodiment, the cleaning roll 63 is disposed in such a manner that its cleaning layer 632 is in contact with the charging layer 612 of the upstream charging roll 61 and the charging layer 622 of the downstream charging roll 62. And the cleaning roll 63 rotates following the upstream charging roll 61 and the downstream charging roll 62. As a result, in the charger 60E according to this exemplary embodiment, foreign matter that is stuck to the surfaces of the upstream charging roll 61 and the downstream charging roll 62, such as dust and residual toner, is removed, that is, transferred to the surface of the cleaning roll 63.

Since the cleaning roll 63 rotates following the upstream charging roll 61 and the downstream charging roll 62, the friction of the cleaning layer 632 of the cleaning roll 63 is made lower than in, for example, a case that the cleaning roll 63 does not rotate. As a result, the life of the cleaning roll 63 is made longer than in cases that the structure of this exemplary embodiment is not employed.

Furthermore, in the exemplary embodiment, the one cleaning roll 63 is brought into contact with both of the upstream charging roll 61 and the downstream charging roll 62. Therefore, the configuration of the charger 60E is simpler than in a case that separate cleaning rolls are provided for the upstream charging roll 61 and the downstream charging roll 62 and hence is reduced in size.

In the exemplary embodiment, from the viewpoint of increasing the cleaning efficiency of the cleaning roll 63, it is preferable that the charging layer 612 of the upstream charging roll 61 and the charging layer 622 of the downstream charging roll 62 be different from each other in surface roughness. More specifically, it is preferable that the surface roughness of the charging layer 622 of the downstream charging roll 62 be higher than that of the charging layer 612 of the upstream charging roll 61.

Where the surface roughness of the charging layer 622 of the downstream charging roll 62 is set higher than that of the charging layer 612 of the upstream charging roll 61, stronger friction force acts between the downstream charging roll 62 and the cleaning roll 63 than between the upstream charging roll 61 and the cleaning roll 63. Therefore, in the charger 60E according to this exemplary embodiment, the cleaning roll 63 rotates following the downstream charging roll 62 dominantly. As a result, the downstream charging roll 62 is cleaned more properly.

To charge the photoreceptor drum 11 by the charger 60E which is equipped with the upstream charging roll 61 and the downstream charging roll 62, first, the photoreceptor drum 11 is subjected to smooth-out charging and preliminary charging using the upstream charging roll 61. Then the photoreceptor drum 11 is subjected to main charging with the downstream charging roll 62. Therefore, the performance of the charger 60E according to the exemplary embodiment mainly depends on that of the downstream charging roll 62.

Therefore, reduction of the performance of the charger 60E is suppressed by virtue of the above-described measure that the downstream charging roll 62 is cleaned more properly by the cleaning roll 63 by setting the surface roughness of the charging layer 622 of the downstream charging roll 62 higher than that of the charging layer 612 of the upstream charging roll 61. This leads to an advantage that the life of the charger 60E is made longer than in a case that the charging layer 612 of the upstream charging roll 61 and the charging layer 622 of the downstream charging roll 62 have the same surface roughness.

(Modification)

Figure 13:
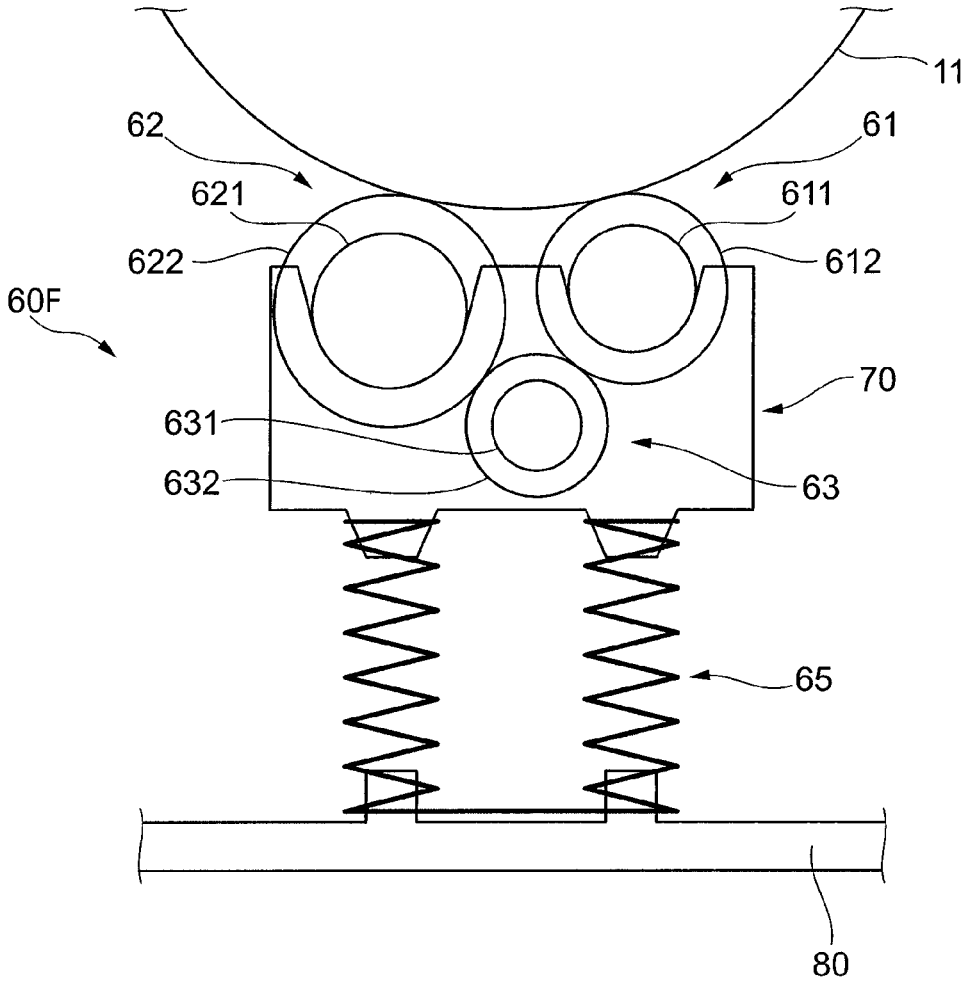
FIG. 13 shows a charger according to a modification which is a modified version of the charger according to the second exemplary embodiment.

FIG. 13 shows a charger 60F according to a modification which is a modified version of the charger 60E according to the second embodiment. In this modification, the upstream charging roll 61 and the downstream charging roll 62 are different from each other in diameter. More specifically, in the charger 60F shown in FIG. 13, the diameter of the downstream charging roll 62 is longer than that of the upstream charging roll 61.

Since the diameter of the downstream charging roll 62 is longer than that of the upstream charging roll 61, the contact area between the downstream charging roll 62 and the cleaning roll 63 is wider than that between the upstream charging roll 61 and the cleaning roll 63. As a result, stronger friction force acts between the downstream charging roll 62 and the cleaning roll 63 than between the upstream charging roll 61 and the cleaning roll 63. Therefore, the downstream charging roll 62 is cleaned more properly by the cleaning roll 63 and hence reduction of the performance of the charger 60F is suppressed. This leads to an advantage that the life of the charger 60E is made longer than in a case that the upstream charging roll 61 and the downstream charging roll 62 have the same diameter.

The method for making the friction force acting between the downstream charging roll 62 and the cleaning roll 63 stronger than that acting between the upstream charging roll 61 and the cleaning roll 63 is not limited to the above-described one. One example is to set the load exerted on the downstream charging roll 62 from the cleaning roll 63 heavier than that on upstream charging roll 61.

Exemplary Embodiment 3

Next, a third exemplary embodiment of the invention will be described. As described later in detail, in the third exemplary embodiment, the surface roughness of the charging layer 622 of the downstream charging roll 62 is set lower than that of the charging layer 621 of the upstream charging roll 61.

Incidentally, in the charger 60 in which the photoreceptor drum 11 is charged by the upstream charging roll 61 and the downstream charging roll 62 and the surface roughness of the of the charging layer 621 of the upstream charging roll 61 is the same as that of the charging layer 622 of the downstream charging roll 62, charging unevenness (potential unevenness) may occur in the surface of the photoreceptor drum 11 charged, resulting in density unevenness of an image.

Figure 14A:
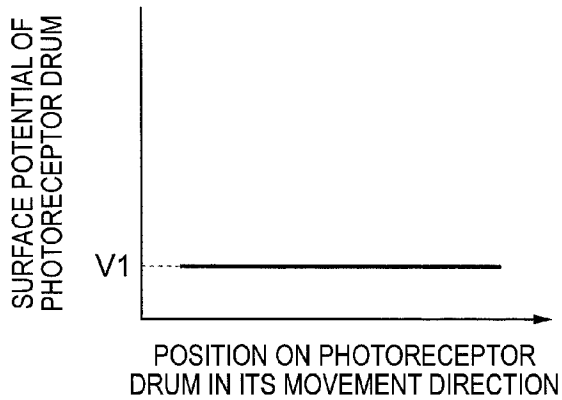
FIGS. 14A, 14B, 14C and 14D illustrate a process that charging unevenness occurs in the photoreceptor drum when it is charged by the charger.
Figure 14B:
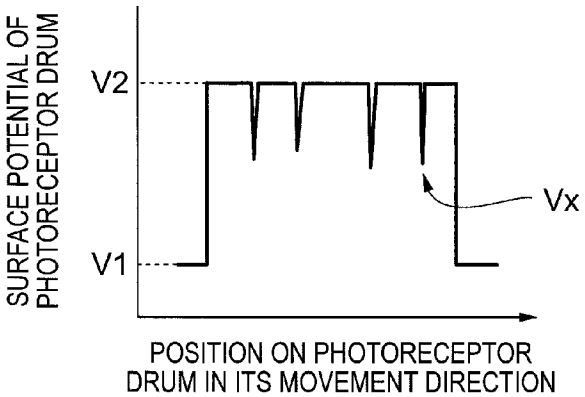
Figure 14C:
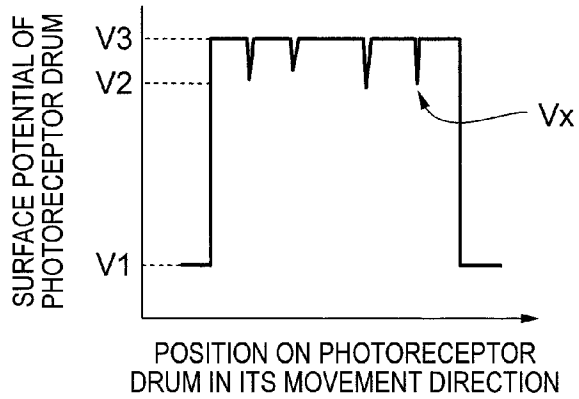
Figure 14D:
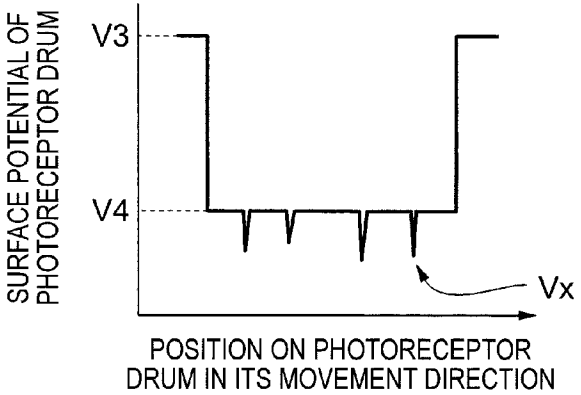

FIGS. 14A-14D illustrate a process that charging unevenness occurs in the photoreceptor drum 11 when it is charged by the charger 60, and show how the surface potential distribution of the photoreceptor drum 11 varies as it is charged. FIG. 14A shows a surface potential distribution in a region X1 (see FIG. 3) of the photoreceptor drum 11 before it is charged by the charger 60. FIG. 14B shows a surface potential distribution in a region X2 (see FIG. 3) of the photoreceptor drum 11 after the charging by the upstream charging roll 61 before charging by the downstream charging roll 62. FIG. 14C shows a surface potential distribution in a region X3 (see FIG. 3) of the photoreceptor drum 11 after the charging by the downstream charging roll 62 before exposure by the exposing unit 13. FIG. 14D shows a surface potential distribution in a region X4 (see FIG. 3) of the photoreceptor drum 11 after the exposure by the exposing unit 13.

As shown in FIGS. 14A and 14B, when charged by the upstream charging roll 61, the potential of the photoreceptor drum 11 is changed from a pre-charging potential V1 to a post-charging potential V2. As shown in FIG. 14B, a very low degree of potential unevenness may occur in the surface of photoreceptor drum 11 after the charging by the upstream charging roll 61. More specifically, very small potential variations Vx (their potentials are lower than the first charging potential V2) may be formed because the distance between the upstream charging roll 61 and the photoreceptor drum 11 varies due to stains on the charging layer 612 of the upstream charging roll 61, polishing traces (in the case where the charging layer 612 is formed by polishing), and other factors. For example, as shown in FIG. 14B, plural very small potential variations Vx are formed at intervals in the movement direction of the photoreceptor drum 11.

When the photoreceptor drum 11 is thereafter charged by the downstream charging roll 62, as shown in FIG. 14C the photoreceptor drum 11 is given a predetermined second charging potential V3. After being charged by the downstream charging roll 62, the photoreceptor drum 11 is subjected to exposure by the exposing unit 13 and its surface potential is thereby made equal to a predetermined exposure potential V4 (see FIG. 14D).

Where the surface roughness of the of the charging layer 621 of the upstream charging roll 61 is the same as that of the charging layer 622 of the downstream charging roll 62, even when the photoreceptor drum 11 is charged by downstream charging roll 62, the very small potential variations Vx that were formed by the charging by the upstream charging roll 61 may not disappear completely to remain on the surface of the photoreceptor drum 11 in a manner shown in FIG. 14C. In particular, such potential variations tend to occur in the case of the charger 60 which is of what is called a DC charging type in which only a DC voltage is applied to the upstream charging roll 61 and the downstream charging roll 62.

If the photoreceptor drum 11 is subjected to exposure by the exposing unit 13 in a state that very small potential variations Vx remain after the charging by the downstream charging roll 62, very small potential variations Vx may appear in the potential distribution (exposure potential: V4) in a manner shown in FIG. 14D. The very small potential variations Vx may cause density unevenness lines (image defects) extending in the width direction of the photoreceptor drum 11 in an image that is developed on the photoreceptor drum 11 after the exposure and then transferred to a sheet.

In contrast, in a charger 60G according to this exemplary embodiment, the problem of very small potential variations Vx occurring on the photoreceptor drum 11 is solved by setting the surface roughness of the charging layer 622 of the downstream charging roll 62 lower than that of the charging layer 621 of the upstream charging roll 61.

For example, the surface roughness of the charging layer 621 of the upstream charging roll 61 is set in a range of 10 to 16 μm (10-point average roughness Rz) and the surface roughness of the charging layer 622 of the downstream charging roll 62 is set in a range of 4 to 8 μm.

One method for establishing the above surface roughness relationship between the charging layer 621 of the upstream charging roll 61 and the charging layer 622 of the downstream charging roll 62 is to use, as the upstream charging roll 61, an unpolished roll whose charging shaft 621 is formed by extrusion or punching and use, as the upstream charging roll 62, a polished roll whose charging layer 622 is formed by polishing.

According to the exemplary embodiment, even if very small potential variations Vx occur in the surface of the photoreceptor drum 11 when it is charged by the upstream charging roll 61, they can be removed when the photoreceptor drum 11 is charged by the downstream charging roll 62, whereby occurrence of density unevenness in an image (image defects) can be suppressed.

Figure 15A:
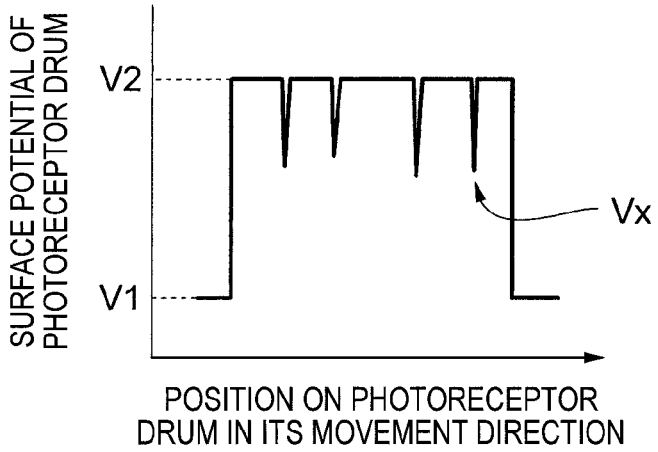
FIGS. 15A, 15B and 15C illustrate how the charger according to the third exemplary embodiment works.
Figure 15B:
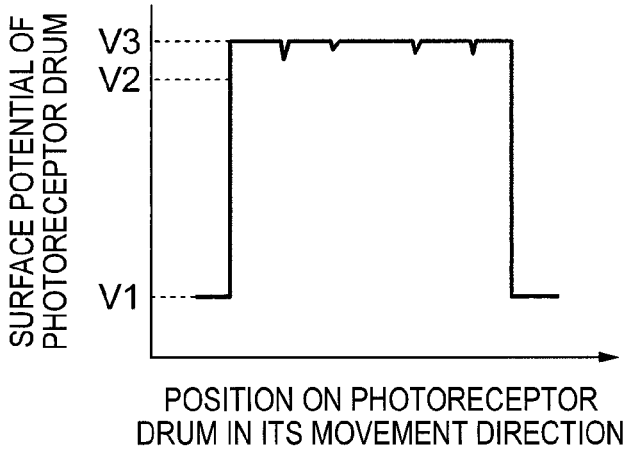
Figure 15C:
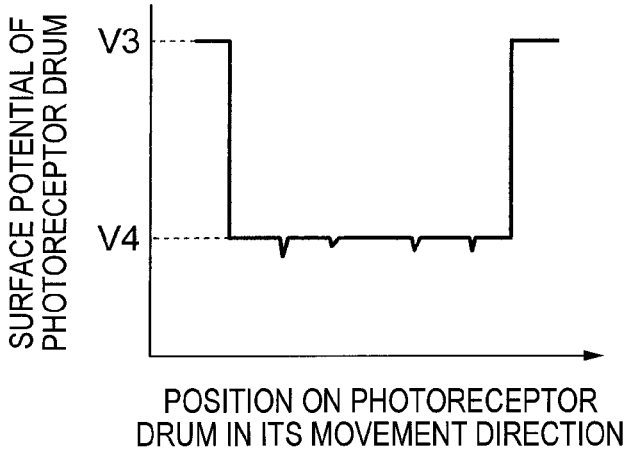

FIGS. 15A-15C illustrate how the charger 60G according to the third exemplary embodiment works, that is, show how the surface potential distribution of the photoreceptor drum 11 varies as it is charged in the case where the surface roughness of the charging layer 622 of the downstream charging roll 62 is lower than that of the charging layer 621 of the upstream charging roll 61. FIG. 15A shows a surface potential distribution of the photoreceptor drum 11 after charging by the upstream charging roll 61 before charging by the downstream charging roll 62. FIG. 15B shows a surface potential distribution of the photoreceptor drum 11 after the charging by the downstream charging roll 62 before exposure by the exposing unit 13. FIG. 15C shows a surface potential distribution of the photoreceptor drum 11 after the exposure by the exposing unit 13.

With the charger 60G according to the exemplary embodiment, even if very small potential variations Vx occur in the surface of the photoreceptor drum 11 in a manner shown in FIG. 15A when it is charged by the upstream charging roll 61, they can be removed as shown in FIG. 15B when the photoreceptor drum 11 is charged by the downstream charging roll 62.

More specifically, since the surface roughness of the charging layer 622 of the downstream charging roll 62 is lower than that of the charging layer 621 of the upstream charging roll 61, the variation of the distance between the downstream charging roll 62 and the photoreceptor drum 11 is small in the region where they are opposed to each other. As a result, the photoreceptor drum 11 is charged by the downstream charging roll 62 also in the region having the very small potential variations Vx and the very small potential variations Vx are thus removed from the photoreceptor drum 11.

Since very small potential variations Vx on the photoreceptor drum 11 disappear after charging by the downstream charging roll 62, occurrence of very small potential variations Vx in the surface of the photoreceptor drum 11 after exposure by the exposing unit 13 is suppressed. As a result, occurrence of density distribution in an image (image defects) is suppressed.

According to the exemplary embodiment, since the surface roughness of the downstream charging roll 62 (charging layer 622) is lower than that of the upstream charging roll 61 (charging layer 621), sticking of foreign matter such as dust and external additives contained in toner to the surface of the downstream charging roll 62 (charging layer 622) is suppressed.

More specifically, since the surface roughness of the upstream charging roll 61 (charging layer 621) is higher than that of the downstream charging roll 62 (charging layer 622), foreign matter that remains on the photoreceptor drum 11 without being removed by the drum cleaner 16 (see FIG. 1) is less prone to be deposited on the surface of the downstream charging roll 62 than the surface of the upstream charging roll 61.

Since as mentioned above the performance of the charger 60 tends to mainly depend on that of the downstream charging roll 62, the measure of the exemplary embodiment suppresses degradation of the performance of the downstream charging roll 62 due to deposition of foreign manner, leading to life elongation of the charger 60.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A charging unit comprising:

a charging member that contacts with an image holding body holding an image and charges a surface of the image holding body;

a support member that supports the charging member; and a pressing member that has plural springs that expand and contract in a direction from the support member to the image holding body, and pushes the support member toward the image holding body, wherein:

at least two of the plural springs of the pressing member are formed by a single metal wire.

2. The charging unit according to claim 1, further comprising an attachment partner member to which at least one of the springs that are formed by a single metal wire is attached by close fit and the other springs are attached by clearance fit.

3. The charging unit according to claim 1, wherein an electricity supply unit that supplies electricity to the charging member via the support member is connected between the plural springs of the pressing member.

4. The charging unit according to claim 1, wherein expansion/contraction directions of the plural springs of the pressing member cross each other so that the plural springs come closer to each other as the position goes toward the image holding body.

5. The charging unit according to claim 1, wherein:

the charging member comprises plural charging rolls that extend parallel with an axial direction of the image holding body and are supported rotatably by the support member; and the plural springs of the pressing member are disposed so as to push the plural respective charging rolls.

6. A charging unit comprising:

plural charging members that charge an image holding body that holds an image while being rotated in a state that the plural charging members are simultaneously in contact with a surface of the image holding body; and a cleaning member that cleans respective surfaces of the plural charging members while being rotated following at least one of the plural charging members in a state that the cleaning member is simultaneously in contact with the plural charging members.

7. The charging unit according to claim 6, wherein the plural charging members include:

a first charging member that rotates being in contact with the surface of the image holding body; and a second charging member that rotates being in contact with the surface of the image holding body at a position downstream of the first charging member in a movement direction of the image holding body, and produces a stronger friction force with the cleaning member than the first charging member does.

8. The charging unit according to claim 6, wherein the plural charging members include:

a first charging member that rotates being in contact with the surface of the image holding body; and a second charging member that rotates being in contact with the surface of the image holding body at a position downstream of the first charging member in a movement direction of the image holding body, and is higher in surface roughness than the first charging member.

9. The charging unit according to claim 6, wherein the plural charging members include:

a first charging member that rotates being in contact with the surface of the image holding body; and a second charging member that rotates being in contact with the surface of the image holding body at a position downstream of the first charging member in a movement direction of the image holding body, and is larger in diameter than the first charging member.

10. The charging unit according to claim 6, further comprising:

a support member that supports the plural charging members and the cleaning member rotatably; and a pressing member that has plural springs that are formed by a single metal wire and expand and contract in a direction from the support member to the image holding body, and pushes the support member toward the image holding body.

11. A charging unit comprising:

a first charging member that contacts with a surface of an image holding body rotating and holding an image and charges the image holding body; and a second charging member that contacts with the surface of the image holding body and charges the image holding body at a position downstream of the first charging member in a movement direction of the image holding body, and is lower in surface roughness than the first charging member, wherein the first charging member comprises a charging layer in which a conductive elastic layer and a surface layer are stacked, the second charging member comprises a charging layer in which a conductive elastic layer and a surface layer are stacked, and a surface roughness of the surface layer of the second charging member is lower than a surface roughness of the surface layer of the first charging member.

12. The charging unit according to claim 11, wherein only a DC voltage is applied to the first charging member and the second charging member.

13. The charging unit according to claim 11, further comprising:

a support member that supports the first charging member and the second charging member rotatably; and a pressing member that has plural springs that are formed by a single metal wire and expand and contract in a direction from the support member to the image holding body, and pushes the support member toward the image holding body.

14. The charging unit according to claim 11, a surface roughness Rz of the surface layer of the first charging member is 10 to 16 μm and a surface roughness Rz of the surface layer of the second charging member is 4 to 8 μm.

* * * * *